US007451571B2

(12) United States Patent
Allen

(10) Patent No.: US 7,451,571 B2
(45) Date of Patent: Nov. 18, 2008

(54) KICKOUT FLASHING AND ASSOCIATED ASSEMBLY AND METHOD

(76) Inventor: L. Ross Allen, 1201 Jericho La., Charlotte, NC (US) 28270

( * ) Notice: Subject to any disclaimer, the term of this patent is extended or adjusted under 35 U.S.C. 154(b) by 844 days.

(21) Appl. No.: 10/779,911

(22) Filed: Feb. 17, 2004

(65) Prior Publication Data

US 2005/0183345 A1 Aug. 25, 2005

(51) Int. Cl.

| | |
|---|---|
| ***E04D 13/00*** | (2006.01) |
| ***E04D 13/12*** | (2006.01) |
| ***E04D 1/36*** | (2006.01) |
| ***E04D 3/38*** | (2006.01) |
| ***E04D 13/14*** | (2006.01) |
| ***E04D 15/00*** | (2006.01) |
| ***B61D 17/14*** | (2006.01) |
| ***E06B 1/04*** | (2006.01) |

(52) U.S. Cl. ..... 52/58; 52/13; 52/24; 52/41; 52/97; 52/211

(58) Field of Classification Search ..... 52/13, 52/24, 41, 42, 43, 44, 58, 62, 97, 211
See application file for complete search history.

(56) References Cited

U.S. PATENT DOCUMENTS

| | | | | |
|---|---|---|---|---|
| 1,677,130 | A | 7/1928 | Cherry | |
| 3,698,142 | A | 10/1972 | Theriault | |
| 4,391,068 | A * | 7/1983 | Kosar | 52/97 |
| 4,555,882 | A | 12/1985 | Moffitt et al. | |
| 5,077,943 | A * | 1/1992 | McGady | 52/58 |
| 5,109,641 | A | 5/1992 | Halan | |
| 5,333,419 | A * | 8/1994 | Hickner | 52/58 |
| 5,675,939 | A * | 10/1997 | Hickner | 52/58 |
| 5,894,697 | A * | 4/1999 | Hunter | 52/58 |
| 6,070,370 | A | 6/2000 | Locke | |
| 6,098,343 | A | 8/2000 | Brown et al. | |
| 6,401,401 | B1 | 6/2002 | Williams | |
| 6,412,229 | B2 | 7/2002 | Kuhns | |
| 6,681,530 | B1 * | 1/2004 | Givens | 52/58 |
| 2002/0166292 | A1 * | 11/2002 | Quinn | 52/58 |
| 2003/0131542 | A1 | 7/2003 | Coblentz, Jr. | |

OTHER PUBLICATIONS

Search Report, dated Apr. 5, 2005; PCT/US2005/000351, Filing Date Jun. 1, 2005.

* cited by examiner

*Primary Examiner*—Brian Glessner
*Assistant Examiner*—Branon C Painter
(74) *Attorney, Agent, or Firm*—Alston & Bird LLP

(57) ABSTRACT

A flashing and associated assembly and method for directing water along an interface between a roof and a wall are provided. The flashing, which can be formed as a unitary molded plastic member, has an angled configuration. In particular, a roof portion of the flashing is configured to be disposed on the roof, and first and second flanges extend perpendicularly from the roof portion to define a continuous passage for receiving water. The flanges define an obtuse angle therebetween so that when one flange is disposed against the wall the other flange is configured to direct water flowing along the passage away from the wall. The flashing can be reversible so that the same flashing can be selectively installed at wall-roof interfaces of different configurations.

17 Claims, 1 Drawing Sheet

KICKOUT FLASHING AND ASSOCIATED ASSEMBLY AND METHOD

FIELD OF THE INVENTION

This invention relates to a kickout flashing for directing water along an interface between members of a building, such as a vertical wall and a roof abutting the wall.

BACKGROUND OF THE INVENTION

Flashings are typically disposed at the interfaces formed between roofs and walls of buildings to prevent water from leaking through the interfaces to the underlying structures. One such interface in a typical building construction is the intersection of a slanted roof with a vertical exterior wall that extends higher than the roof such that the intersection extends perpendicular to the wall at a slant defined by the angle of the roof. L-shaped pieces of flexible metal flashing are typically provided at the intersection so that a first leg of each flashing is disposed against the roof and a perpendicular second leg is disposed against the wall. Successive pieces of the flashing are installed along the intersection so that each piece of flashing is overlapped by the next successively higher piece of flashing. Thus, water flowing along the intersection of the roof and wall flows to the bottom of the roof without penetrating the flashing to the underlying roof or wall materials. Typically, shingles and wood siding are installed on the roof and wall, respectively, at least partially covering the flashings. As an alternative to wood siding, conventional stucco or stone can be used.

At the bottom of the intersection, the lowermost piece of flashing is typically cut and bent to form an angled kickout in order to direct the water flowing down the roof away from the wall. The cut made in the flashing to facilitate bending and forming the kickout can result in leaking of water, which can flow into the wall behind the siding or under the shingles to the roof, thereby causing damage to the wall or the roof. Conventional kickouts are sometimes sealed with a weld or solder joint or with caulk, but such seals require time for forming and can eventually leak, especially in the case of a caulk seal.

Thus, there exists a need for a device and method for use in directing water along interfacing members of a building and away from the interface, e.g., away from a vertical wall that is abutted by a slanted roof. The device should be relatively easy to install and economical to manufacture. Preferably, the device should be compatible with intersections of different orientations such that a single device can be selectively installed to direct water according to the orientation of each intersection.

SUMMARY OF THE INVENTION

The present invention provides a kickout flashing and an associated assembly and method for directing water along an interface defined between a roof and a wall. The flashing can be formed with an angled configuration so that the flashing does not need to be cut and bent to form an angle during installation. For example, the flashing can be formed of a unitary molded plastic member. Further, the flashing can be reversible so that the same flashing can be selectively installed at interfaces of different configurations.

According to one embodiment of the present invention, the kickout flashing includes a continuous roof portion that is configured to be disposed on a roof and first and second flanges extending perpendicularly from the roof portion. For example, the flanges can extend to a height of at least 3 inches from the roof portion, and preferably about 5 inches. The flanges define an obtuse angle therebetween, and a continuous passage extends along an intersection of the roof portion and each of the flanges for receiving water. Each of the flanges is adapted to be disposed against the wall with the other flange being configured to direct water flowing along the passage away from the wall. For example, the first and second flanges can be substantially equal in size, and the flashing can be substantially symmetric about a plane bisecting the obtuse angle between the flanges. In addition, a stop can extend between the first and second flanges to form a channel with the roof portion, e.g., parallel to the roof portion at a distance of between about ¼ and 1 inch from the roof portion.

The present invention also provides a flashing assembly for directing water along an interface. The assembly includes a vertical wall, a roof that is perpendicular to the wall and defines the interface with the wall, and a flashing disposed at the interface. A continuous roof portion of the flashing is disposed against the roof, and flanges extend perpendicularly from the roof portion to define a continuous passage extending along an intersection between the roof portion and each of the flanges for receiving water. The first flange is disposed against the wall, and the second flange define an obtuse angle with the first flange so that the second flange is configured to direct water flowing along the passage away from the wall. The flashing can be reversibly installed in an alternative assembly with the second flange disposed against a wall of the alternative assembly and the first flange configured to direct water flowing along the passage away from the wall of the alternative assembly. For example, the flanges can be substantially equal in size so that the flashing is substantially symmetric about a plane bisecting the obtuse angle between the flanges. One or more fasteners can be provided for connecting the flashing to the roof or the wall, and the roof portion and the second flange can be trimmed to define an edge that corresponds to an edge of the roof and the wall.

According to one method of the present invention, a roof portion of the flashing is disposed against the roof and one of the flanges is selectively disposed against the wall so that the other flange is configured to direct water flowing along the flanges away from the wall. For example, the flashing can be disposed with one of the flanges against the wall according to the orientation of the roof and the wall. One or more fasteners can then be used to connect the flashing to the roof or the wall. The flashing, which can be formed of a unitary molded plastic member, can be trimmed to remove part of the roof portion and one of the flanges so that the flashing defines an edge corresponding to an edge of the roof and the wall.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, but which are not necessarily drawn to scale, wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
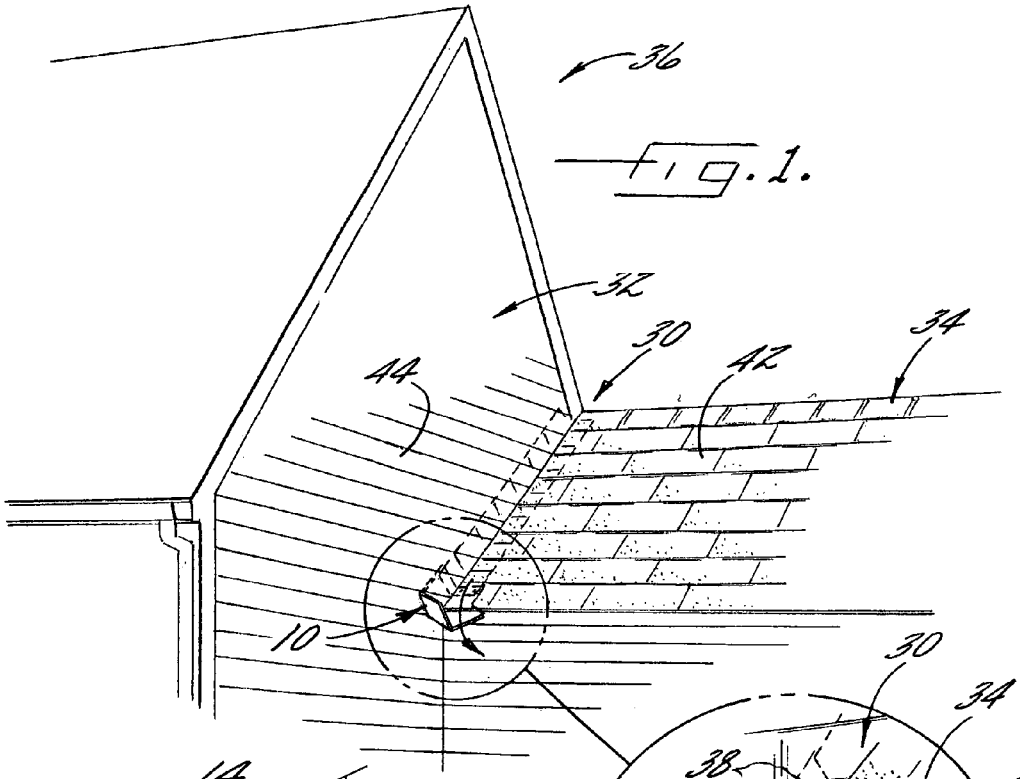
FIG. 1 is a perspective view illustrating a building with a vertical wall and a slanted roof abutting the wall and defining an interface therebetween, with a kickout flashing according to one embodiment of the present invention being disposed at a lower end of the wall-roof interface.
Figure 2:
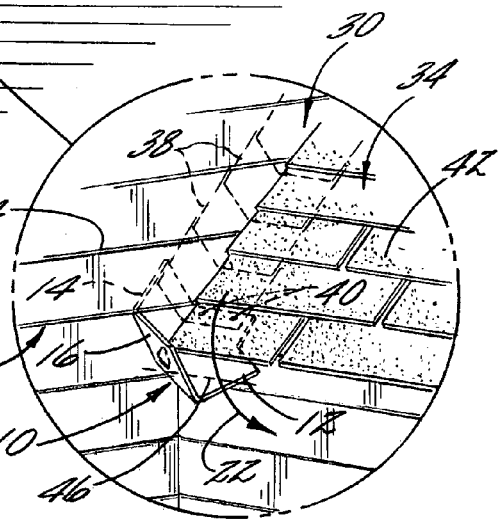
FIG. 2 is an enlarged partial view of a portion of the interface of FIG. 1 as indicated in FIG. 1.

Referring to the drawings and, in particular, to FIG. 1, there is shown a kickout flashing 10 according to one embodiment of the present invention installed at the interface 30 of a building 36 where a slanted roof 34 abuts a vertical wall 32. The kickout flashing 10 can be used in conjunction with conventional pieces of flashing, such as L-shaped flashings 38 that are arranged in a successively overlapping configuration along the wall-roof interface 30. As shown in FIGS. 1 and 2, the kickout flashing 10 is configured to direct water flowing along the interface 30 away from the wall 32, e.g., to prevent the water from leaking through siding 44 the wall 32 or shingles 42 on the roof 34 and damaging the underlying wall or roof materials to which the siding 44 and shingles 42 are attached.

Accordingly, the flashing 10 is preferably formed of a waterproof material. For example, the flashing 10 can be formed of a variety of materials including polymers, metals, and the like. In one advantageous embodiment of the invention, the flashing 10 is formed as a unitary member of plastic, such as polypropylene, polyethylene, or polyvinyl chloride (PVC). For example, the flashing 10 can be formed by a conventional injection molding operation using one or more dies that cooperably define a die cavity corresponding to the configuration of the flashing 10 so as to form the flashing as a unitary, relatively rigid, molded plastic member.

Figure 3:
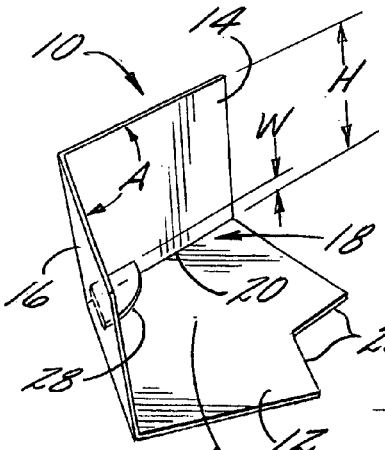
FIG. 3 is a perspective view of the kickout flashing of FIG. 1, shown in a first or "right-hand" orientation.

As shown in FIG. 3, the flashing 10 includes a roof portion 12 and first and second flanges 14, 16 extending therefrom. The roof portion 12 is continuous, i.e., is substantially free of cracks, holes, or other apertures through which water can flow. The flanges 14, 16 generally extend from the roof portion 12 at an angle that corresponds to the angle between the roof 34 and the wall 32. For example, in the case where the wall 32 and roof 34 are perpendicular as shown in FIG. 1, the flanges 14, 16 are similarly perpendicularly to the roof portion 12 of the flashing 10. In addition, the first and second flanges 14, 16, each of which can be planar, define an obtuse angle A therebetween. Thus, when the roof portion 12 is disposed against the roof 34, an outer surface of one of the flanges 14, 16 (e.g., the first flange 14, as shown in FIGS. 1 and 2) can be disposed against the wall 32 of the building 36 and secured thereto. The other flange (the second flange 16, as shown in FIGS. 1 and 2) is disposed at an angle relative to the wall 32. Thus, the flashing 10 defines a continuous passage 18 that extends along an intersection 20 of the roof portion 12 and each of the flanges 14, 16, and the passage 18 is nonlinear by virtue of the obtuse angle A defined between the flanges 14, 16. As water flows from the wall 32 or roof 34 through the flashing 10, the water is directed along the continuous roof portion 12 in direction 22 away from the intersection 20 and away from the wall 32. A height H of the flanges 14, 16, as measured in a direction perpendicular to the roof portion 12, can be sufficiently large so that water does not typically flow over the flanges 14, 16 and out of the passage 18 of the flashing 10. For example, according to one embodiment of the present invention, each of the flanges 14, 16 has a height H of at least about 3 inches, and preferably about 5 inches.

While the flashing 10 of the present invention is not limited to any particular angle or range of angles between the flanges 14, 16, it is appreciated that the angle A can be designed according to such factors as the slant angle of the roof 34, the size of the flashing 10, the expected maximum flow of water through the flashing 10, and the like. In particular, it is understood that the water flowing through the flashing 10 can be diverted away from the wall 32 to a greater extent by decreasing the angle A between the flanges 14, 16. However, if the angle A is too small, some of the water may spill over the second flange 16. According to one embodiment of the present invention, the obtuse angle A between the flanges 14, 16 is between about 100 and 140 degrees.

Figure 4:
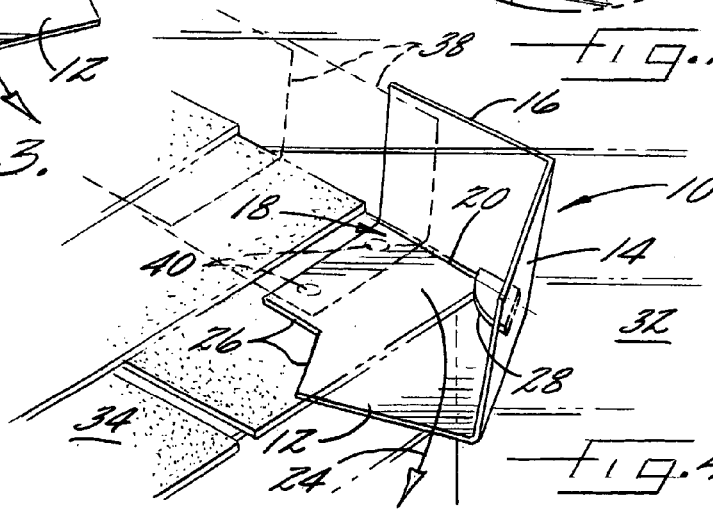
FIG. 4 is a perspective view of the kickout flashing of FIG. 1, shown in a second or "left-hand" orientation.

In one advantageous embodiment of the present invention, the flashing 10 is reversible, i.e., the flashing 10 can be selectively installed in multiple configurations. For example, the first and second flanges 14, 16 can be substantially equal in size so that the flashing 10 is substantially symmetric about a plane bisecting the obtuse angle A between the flanges 14, 16. Thus, the flashing 10 can be selectively installed in alternate orientations with either of the flanges 14, 16 disposed against the wall 32 and the other of the flanges 14, 16 extending at an angle from the wall 32 to direct water flowing through the passage 18 away from the wall 32. More particularly, the flashing 10 can be installed in a "right-hand" orientation, as shown in FIGS. 1-3, with the first flange 14 disposed against the wall 32 and the second flange 16 configured to direct water away from the wall 32 in direction 22. Alternatively, the flashing 10 can be installed in a "left-hand" orientation, as shown in FIG. 4, with the second flange 16 disposed against the wall 32 and the first flange 14 configured to direct water away from the wall 32 in direction 24. In addition, an edge 26 of the roof portion 12 that is opposite the flanges 14, 16 can define the same obtuse angle A that is defined between the flanges 14, 16 so that part of the edge 26 is parallel to the first flange 14 and part of the edge 26 is parallel to the second flange 16.

Thus, the flashing 10 can be selectively installed in either orientation according to the orientation of the wall 32 and the roof 34. That is, if the roof 34 is situated to the right of the wall 32, as viewed from the ground in front of the roof 34 and as shown in FIG. 1, the flashing 10 can be installed in the right-hand orientation so that water is directed away from the wall in direction 22. Alternatively, if the roof 34 is situation to the left of the wall 32, i.e., a mirror image of FIG. 1, the flashing 10 can be installed in the left-hand orientation to direct water in direction 24 and away from the wall 32. Such reversibility of the flashing 10 can reduce the number of variations in the flashing 10 that must be manufactured, supplied, and inventoried, thereby simplifying the manufacture and overall use of the flashing 10 and possibly reducing the costs associated with its manufacture and use.

As shown in the figures, the flashing 10 can also include a tab or siding stop 28 that extends between the flanges 14, 16 generally parallel to and spaced above the roof portion 12. The stop 28 and the roof portion 12 define a channel therebetween through which water can flow, and the siding stop 28 prevents material from falling into the channel. For example, if the kickout flashing 10 is installed before stucco siding is applied to the wall 32, the stop 28 can prevent uncured stucco from falling into the channel and blocking the flow of water through the flashing 10. The stop 28 can also prevent other types of siding, debris such as leaves, or the like from falling onto the roof portion 12 and blocking the flow of water through the flashing 10. Typically, the width W of the channel as measured between the stop 28 and the roof portion 12 is between about ¼ inch and 1 inch, though various other configurations of the stop 28 can alternatively be used.

During one typical installation operation, the flashing 10 is provided as a unitary molded plastic member, which is relatively rigid and defines the roof portion 12 and flanges 14, 16 as described above. Generally, the kickout flashing 10 has an angled configuration for directing water away from the wall 32 and does not need to be cut or bent during installation to achieve the angled configuration. The flashing 10 is disposed in the interface 30 of the wall 32 and the roof 34 according to the orientation of the wall 32 and roof 34. That is, if the wall 32 and roof 34 define a right-hand orientation, the first flange 14 is disposed against the wall 32 so that water will flow through the passage 18 in the direction 22 from the first flange 14 toward the second flange 16. Alternatively, if the wall 32 and roof 34 define a left-hand orientation, the second flange 16 is disposed against the wall 32 so that the water will flow through the passage 18 in the direction 24 from the second flange 16 toward the first flange 14. One or more fasteners 40 can be provided for connecting the flashing 10 to the roof 32 or the wall 34. For example, nails, screws, an adhesive, or the like can be used to secure the flashing 10 in place. Typically, the flashing 10 is then at least partially covered. For example, shingles 42 can be secured to the roof 34 to overlap the roof portion 12 of the flashing 10, and siding 44 can be disposed on the wall 32 to overlap whichever flange 14, 16 is positioned against the wall 32. Various types of siding 44 can be used including, but not limited to, wood, vinyl, or aluminum strip siding, bricks, stucco, and the like. In some cases, if fasteners are to be driven through the flashing 10 to secure the flashing 10 to the wall 32 or roof 34, the nails can be positioned on a portion of the flashing 10 that is to be overlapped by a successive piece of flashing 38, shingle 42, siding 44, or the like.

In addition, the roof portion 12 and/or the flange extending from the wall 32, i.e., the second flange 16 as shown in FIGS. 1 and 2, can be trimmed. For example, as shown in FIG. 2, the roof portion 12 and the second flange 16 can be trimmed along dashed line 46 to form an edge that corresponds to an edge of the roof 34 and to the wall 32. For example, the flashing 10 can be trimmed to extend from the roof 34 by a particular distance. In some embodiments, the second flange 16 and the roof portion 12 can be trimmed so that neither the roof portion 12 nor the second flange 16 extends from the roof 34. For example, while the second flange 16 is shown to extend entirely beyond the roof 34 in FIG. 2, the flashing 10 can also be installed so that the second flange 16 partially overlaps the roof 34. In that case, the second flange 16 can divert the flow of water away from the wall 32 before the water reaches the lower edge of the roof 34, and the second flange 16 and/or the roof portion 12 of the flashing 10 can be trimmed to be coterminous with the roof 34. Of course, if the flashing 10 is installed in a left-hand orientation with the second flange 16 against the wall 34, the first flange 14 can instead be trimmed with the roof portion 12 accordingly.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A kickout flashing for directing water along an interface defined between a roof and a wall, the kickout flashing comprising:

a flat, water impervious roof portion, said roof portion including two straight edges of a substantially equal length and which intersect each other at an obtuse angle; first and second flanges extending perpendicularly from the roof portion along respective ones of said two straight edges of the roof portion and being joined to each other along a continuous joint line which extends perpendicularly with respect to the roof portion from a point at which the two straight edges intersect, with the first and second flanges also being joined to the roof portion along the full length of the respective straight edge thereof to define a continuous passage extending along an intersection of the roof portion and each of the flanges for receiving guiding water; and a stop extending parallel to the roof portion and between the first and second flanges to form a channel between the stop and the roof portion; wherein the first and second flanges have rectangular outlines of substantially equal outline and size such that the flashing is substantially symmetric about a plane bisecting said obtuse angle and which includes the joint line between the flanges, such that the flashing is configured to be installed in either of two alternative orientations with the flat roof portion disposed on the roof and with one of the first and second flanges disposed against the wall and with the other flange being configured to direct water flowing along the passage away from the wall.

2. A flashing according to claim 1 wherein each of the flanges defines an outer surface directed away from the passage, the outer surfaces being substantially planar.

3. A flashing according to claim 1 wherein the obtuse angle is between about 100 and 140 degrees.

4. A flashing according to claim 1 wherein the flashing is formed of a unitary molded plastic member.

5. A flashing according to claim 1 wherein the stop defines a smaller area than the roof portion, and is disposed between about ¼ and 1 inch from the roof portion.

6. A flashing according to claim 1 wherein the roof portion defines an edge portion opposite each of the first and second flanges, the edge portions extending parallel to respective ones of the intersecting straight edges to define an angle equal to the obtuse angle of the intersecting straight edges.

7. A flashing according to claim 1 wherein each of the flanges has a height of at least about 3 inches.

8. A flashing assembly for directing water along an interface, the assembly comprising:

a vertical wall;

a flat roof extending in a direction which is inclined from the horizontal and perpendicular to the wall and defining the interface with the wall; and a flashing disposed at the interface of the wall and the roof, the flashing comprising:

a flat, water impervious roof portion disposed against the roof, said roof portion including two straight edges of substantially equal length and which intersect each other at an obtuse angle;

first and second flanges extending perpendicularly from the roof portion along respective ones of said two straight edges of the roof portion and being joined to each other along a continuous joint line which extends perpendicularly with respect to the roof portion from a point at which the two straight edges intersect, with the first and second flanges also being joined to the roof portion along the full length of the respective straight edge thereof to define a continuous passage extending along an intersection between the roof portion and each of the flanges for receiving and guiding water; and a stop extending parallel to the roof portion and between the first and second flanges to form a channel between the stop and the roof portion; wherein the first and second flanges have rectangular outlines of substantially equal outline and size such that the flashing is substantially symmetric about a plane bisecting said obtuse angle and which includes the joint line between the flanges, the first flange being disposed against the wall and the second flange defining an obtuse angle with the first flange such that the second flange is configured to direct water flowing along the passage away from the wall, and wherein the flashing is configured to be reversibly installed in an alternative assembly having an opposite orientation such that the second flange is disposed against a wall of the alternative assembly and the first flange is configured to direct water flowing along the passage away from the wall of the alternative assembly.

9. An assembly according to claim 8, further comprising a fastener disposed to connect the flashing to at least one of the roof and the wall.

10. An assembly according to claim 8 wherein each of the flanges defines an outer surface directed away from the passage, the outer surfaces being substantially planar.

11. An assembly according to claim 8 wherein the obtuse angle is between about 100 and 140 degrees.

12. An assembly according to claim 8 wherein the flashing is formed of a unitary molded plastic member.

13. An assembly according to claim 8 wherein the stop defines a smaller area than the roof portion, and the stop is disposed between about ¼ and 1 inch from the roof portion.

14. An assembly according to claim 8 wherein the roof portion defines an edge portion opposite each of the first and second flanges, the edge portions extending parallel to respective ones of the two straight edges to define an angle equal to the obtuse angle defined by the two straight edges.

15. An assembly according to claim 8 wherein the passage formed between the roof portion and the first flange is parallel to and adjacent the interface of the roof and vertical wall.

16. An assembly according to claim 8 wherein each of the flanges has a height of at least about 3 inches.

17. A flashing according to claim 1 wherein said roof portion further includes two additional straight edges which extend perpendicularly from respective ones of said first mentioned two straight edges.

* * * * *